US008173943B2

(12) United States Patent
Ristola et al.

(10) Patent No.: US 8,173,943 B2
(45) Date of Patent: May 8, 2012

(54) APPARATUS FOR MICROWAVE HEATING OF A PLANAR PRODUCT INCLUDING A MULTI-SEGMENT WAVEGUIDE ELEMENT

(75) Inventors: Pete Ristola, Lammi (FI); Jaakko Vilo, Turku (FI); Jerzy Piotrowski, Warsaw (PL)

(73) Assignee: Raute Oyj, Nastola (FI)

( * ) Notice: Subject to any disclaimer, the term of this patent is extended or adjusted under 35 U.S.C. 154(b) by 226 days.

(21) Appl. No.: 12/559,129

(22) Filed: Sep. 14, 2009

(65) Prior Publication Data

US 2010/0060391 A1 Mar. 11, 2010

(30) Foreign Application Priority Data

Sep. 11, 2008 (FI) ..... 20085855

(51) Int. Cl.
*H05B 6/70* (2006.01)
*H01P 3/123* (2006.01)

(52) U.S. Cl. ..... 219/690; 333/248; 333/34; 333/21 R; 219/695; 219/697

(58) Field of Classification Search ..... 219/690, 219/697, 695, 686, 693; 333/21 R, 125, 333/137, 34, 239, 248
See application file for complete search history.

(56) References Cited

U.S. PATENT DOCUMENTS

| | | | | |
|---|---|---|---|---|
| 2,767,380 | A | 10/1956 | Zobel | |
| 2,960,671 | A | 11/1960 | Ohm | |
| 3,564,458 | A | 2/1971 | Cumming | |
| 3,851,132 | A | 11/1974 | VanKoughnett | |
| 4,764,775 | A * | 8/1988 | Craven | 343/786 |
| 6,693,266 | B1 * | 2/2004 | Yagi | 219/695 |

FOREIGN PATENT DOCUMENTS

| | | |
|---|---|---|
| CA | 2443799 A1 | 4/2004 |
| EP | 0940060 B1 | 2/2007 |
| GB | 893936 | 4/1960 |
| GB | 1016435 | 1/1966 |

* cited by examiner

*Primary Examiner* — Benny Lee
(74) *Attorney, Agent, or Firm* — Knoble Yoshida & Dunleavy, LLC

(57) ABSTRACT

The invention relates to a microwave waveguide element for matching a standard waveguide input port to an enlarged waveguide output port. In the waveguide element, a plurality of intermediate waveguide segments is cascaded in the propagation direction of the microwave energy to first split the waveguide element into two symmetrical waveguide branches and then combine the branches at the output port. Thus, the width of the waveguide element is gradually enlarged and the input port is matched to the output port. The intermediate waveguide segments are preferably dimensioned such that respective characteristic impedances are approximately matched with each other for the fundamental mode.

9 Claims, 4 Drawing Sheets

APPARATUS FOR MICROWAVE HEATING OF A PLANAR PRODUCT INCLUDING A MULTI-SEGMENT WAVEGUIDE ELEMENT

FIELD OF THE INVENTION

The invention relates to waveguides for a microwave range, and particularly a waveguide element for use in a microwave heating of planar products, particularly wood panels and boards.

BACKGROUND OF THE INVENTION

A pressed-wood composite product can be produced from a prepared pre-assembly mat which includes selected wood components along with intercomponent, heat-curable adhesive. A typical end product may, for example be plywood, or laminated veneer lumber (LVL), which, after production can be cut for use, or otherwise employed, in various ways as wood-based building components. The starter material would typically be, in addition to a suitable heat-curable adhesive, (a) thin sheet veneers of wood, (b) oriented strands (or other fibrous material) of smaller wood components, (c) already pre-made expanses of plywood which themselves are made up of veneer sheets or (d) other wood elements.

In conventional LVL fabrication processing, LVL is typically made of glued, veneer sheets of natural wood, utilizing adhesives, such as urea-formaldehyde, phenol, resolsenidi, formaldehyde formulations which require heat to complete a curing process or reaction. There are several well-known and widely practiced methods of manufacturing and processing to create LVL. The most common pressing technology involves a platen press, and a method utilizing such a press is described in U.S. Pat. No. 4,638,843. Pressing and heating is typically accomplished by placing precursor LVL between suitable heavy metal platens. These platens, and their facially "jacketed" wood-component charges, are then placed under pressure, and are heated with hot oil or steam to implement the fabrication process. Heat from the platens is slowly transferred through the wood composite product, the adhesive cures after an appropriate span of pressure/heating time. This process is relatively slow, the processing time increasing with the thickness of the product.

U.S. Pat. No. 5,628,860 describes an example of a technique wherein radio frequency (RF) energy is added to the environment within (i.e., in between) opposing press platens to accelerate the heating and curing process and thereby shorten fabrication times.

Still another technique to provide the heating and curing is to utilize microwave energy. U.S. Pat. No. 5,895,546, discloses use of microwave energy to preheat loose LVL lay-up materials, which are then finished in a process employing a hot-oil-heated, continuous-belt press. Also CA 2 443 799 discloses a microwave preheat press. A microwave generator feeds through a waveguide a microwave applicator such the microwave energy is applied to an initial press section which leads into a final press section. Multiple waveguides in a staggered configuration may be used to provide multiple points of application of the microwave energy with a waveguide spacing that yields substantially uniform heating pattern. Heating temperature is adjusted by varying the linear feed rate at which the wood element enters the microwave preheat press, or by controlling the microwave waveform.

EP0940060 discloses another microwave preheat press wherein the microwave energy is feed through waveguide to applicators on both sides of the wood product. The feeding waveguides are provided with sensor for measuring reflected microwave energy, and a tuner section for generating an induced reflection which cancels the reflected energy. The tuner section includes tuning probes whose length within the feeding waveguides are adjusted by a stepper motor.

U.S. Pat. No. 6,744,025 discloses a microwave heating unit formed into a box-like resonant cavity via which the product to be heated is passed. The product is passed via a narrow gap that extends lengthwise through the entire cavity and divides the cavity substantially at the midline of the cavity into two opposed subcavities. The microwave energy to be imposed on the product is fed via a waveguide to one of the subcavities.

U.S. Pat. No. 7,145,117 discloses an apparatus for heating a board product containing glued wood. The apparatus comprises a heating chamber through which the board product passes and in which a microwave heating electrical field is provided to prevail substantially on the board plane, in transversal direction with respect to the proceeding direction of the board, by means of a microwave frequency energy applied perpendicular to the board plane.

GB893936 discloses a microwave heating apparatus wherein a resonant cavity is formed by a segment of a standard waveguide which is a rectangular in transverse cross-section with a longer side and a shorter side. The cavity is coupled to the waveguide through an adjustable matching iris forming one end of the cavity. The cavity can be tuned by means of an adjustable short circuiting piston serving as the other end wall of the cavity. Two opposite longer sides of the standard waveguide cavity are further provided with slots extending lengthwise of the cavity to allow a planar product pass through the cavity between adjustable side plates located on the opposite shorter sides of the cavity. The side plates shorten the longer sides of the cavity with respect to the respective sides of the standard waveguide such that the waveguide segment of cut-off frequency close to an operating frequency is formed. End parts of the cavity beyond the side plates have cross-sectional dimensions of the standard waveguide. A sensor is provided to measure the energy reflected from the cavity. The frequency is tuned so that the energy reflected from the cavity is a minimum. Side plates are then adjusted so as to produce a uniform field across the width of the planar product to be heated. This prior art structure has various drawbacks.

1. The prior art structure is suitable only for heating products with very limited cross-section. The thickness of the heated product shall not exceed 10 to 15% of length of the longer side of the standard waveguide. The width of the heated product (along the longitudinal axis of the cavity) should not be longer than length of the longer side of the standard waveguide.

2. The heating occurs on a distance (along the direction of movement of the heated product) that is equal to the length of the shorter side of the waveguide.

3. Losses in the waveguide metal increases strongly when the operating frequency goes to the cut-off frequency of the waveguide.

4. The cavity has a low Q factor. Insertion of the material to be heated into the cavity will additionally degrade the Q factor of the cavity. This results in non-uniform heating pattern and destruction of the resonant phenomenon.

Also GB1016435 discloses a microwave heating apparatus intended to improve the structure of GB893936. GB1016435 notes as a disadvantage of GB893936 that adjustment of the tuning plunger and adjustment of the iris affect not only the tuning of cavity but also the standing wave pattern in the cavity, and this complicates the provision of the desired uniform distribution of the electric field along the central part of the cavity. In GB1016435, a resonant cavity is formed by a waveguide having a rectangular cross-section with a longer side and a shorter side. The microwave energy is supplied into the cavity by means of a coaxial feeder and a coupling loop. The tuning of the cavity is performed by metal rods which extend lengthwise of the cavity. The waveguide or cavity terminates at each end in an effective open-circuit formed by a waveguide section having larger cross-sectional dimensions than the central cavity section. With this structure, the field intensity along the central cavity is alleged to be substantially uniform along the heating area. However, the structure of GB1016435 has the same disadvantages as listed for GB893936 above. Moreover, tuning by means of a metal rod is questionable, because the metal rod may create with the walls of the waveguide cavity a TEM transmission line of substantially different wavelength than the waveguide, and it may further degrade heating uniformity.

SUMMARY OF THE INVENTION

An object of the present invention is to enable a microwave heating for of larger variety of planar products than the prior art apparatuses. The object of the invention is achieved by means of a waveguide element and an apparatus as recited in the independent claims. The preferred embodiments of the invention are disclosed in the dependent claims.

According to an aspect of the invention, a waveguide element is provided which has an input port with the first standard rectangular cross-section, and an output port with the second enlarged rectangular cross-section. The standard rectangular cross-section and the enlarged second rectangular cross-section are dimensioned with the width of the input port being $b_A$ and the width of the output port being $C*b_A$ in direction of the electric field of the fundamental mode. As the other, initially longer side of the standard rectangular cross-section is maintained unchanged, the cut-off frequency of the fundamental mode is not affected. The electric field is uniformly distributed along the width $b_A$ at the input as well as along the width $C*b_A$ of the enlarged side. The value of factor C may be selected depending on the desired width of the enlarged side.

In microwave heating applications, the value of factor C may be selected depending on the width of the planar product to be heated. In other words, the shorter side of the standard waveguide is enlarged to a length which can accommodate the desired width of the product to be heated. As a result, wider products can be heated and a more uniform heating pattern can be achieved than in the prior art solutions.

The transition from the standard cross-section into the enlarged cross-section may generate undesired modes which interfere with the fundamental mode (e.g. $TE_{10}$ mode) and degrade the uniform distribution of the electric field. According to an aspect of the invention, in order to alleviate the effect of such interferences, a plurality of intermediate waveguide segments are cascaded in the propagation direction of the microwave power for gradually enlargening the width of the waveguide element and matching the input port segment to the output port segment. To this end, the intermediate waveguide segments are arranged to split the waveguide element into two symmetrical waveguide branches which are combined at the output port. The interferences generated in the two symmetrical waveguide branches are of opposite phases such that they cancel each other at the output port. As a result, the uniformity of the electric field is improved. The intermediate waveguide segments are preferably dimensioned such that respective characteristic impedances are approximately matched with each other for the fundamental mode. In an embodiment of the invention, first ones of the intermediate waveguide segments in the cascade are of a length in the propagation direction that is approximately equal to a quarter wavelength. In an embodiment of the invention, a last one of the intermediate waveguide segments in the cascade is of a length in the propagation direction that is approximately equal to a half wavelength.

According to another aspect of the invention, the waveguide branches terminate in symmetrical horn-shaped waveguide segments of width $C*b_A/2$ which are arranged to open to the output port.

According to a still another aspect of invention, an apparatus for microwave heating of a planar product comprises a waveguide element according to various embodiments of the invention, a feeding waveguide having the first standard rectangular cross-section and being connected to the input port of the waveguide element, and a heating cavity having the second rectangular cross-section and being connected to the output port of the waveguide element.

According to a still another aspect of invention, an apparatus for microwave heating of a planar product twice as wide as a single cavity comprises two waveguide elements placed side-by-side.

BRIEF DESCRIPTION OF THE DRAWINGS

In the following the invention will be described in greater detail by means of exemplary embodiments with reference to the attached drawings, in which.

DETAILED DESCRIPTION OF EXEMPLARY EMBODIMENTS

The present invention relates generally to an apparatus for heating a planar product, particularly a wooden board, panel or veneer product containing glued wood, primarily for affecting the hardening reactions of the glue, by applying the heating power to the planar product by means of an alternating electrical field at a microwave frequency. Before the heating step, the board product has been manufactured to be continuous, and it is conveyed through a stationary heating apparatus. The board product generally comprises wood layers arranged parallel to the board, ply layers with intermediate layers of glue to be hardened by means of heat. A typical product is the so-called LVL beam (Laminated Veneer Lumber). The invention is applicable to any types of wood based board products, in which the glued wood component is bound to a solid board construction by hardening the glue. Before being transported to heating, the board product may usually be exposed to pressure in order to get the glued wood components into a close contact and to remove air spaces disturbing the alternating electrical field in the board construction. These other devices, such as the conveyer and the press, are not described in detail herein.

Figure 1:
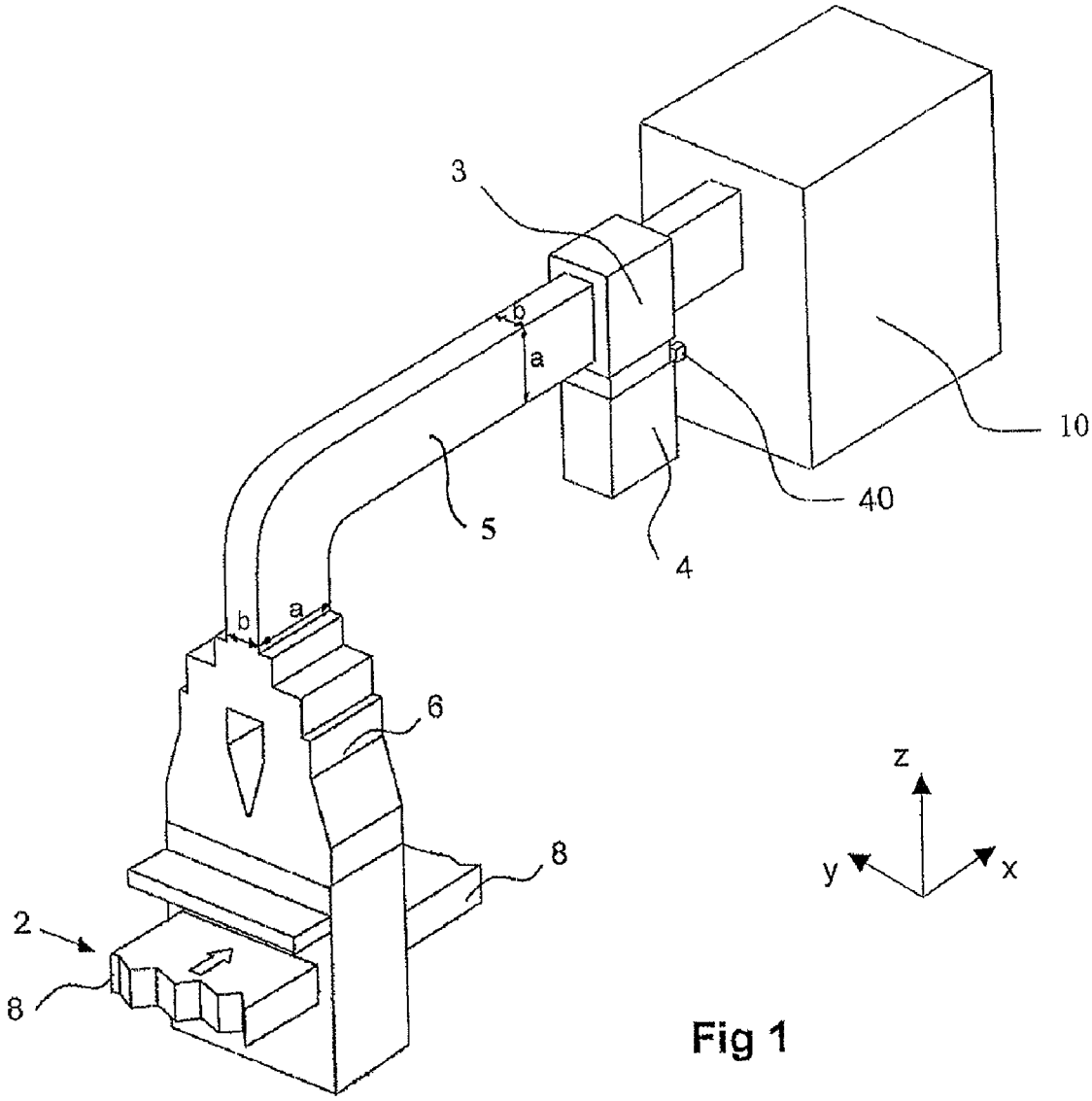
FIG. 1 illustrates an example structure of a heating apparatus according to an embodiment of the present invention.

An example structure of a heating apparatus is illustrated in FIG. 1. A microwave generator 10 may include both a power supply and a remote microwave source (such as a magnetron or a klystron). The generator 10 launches microwaves (e.g. 415 MHz, 915 MHz or 2450 MHz) to a circulator 3. The circulator 3 directs the microwave power from the generator 10 into a feeding waveguide 5, but directs the reflected microwave power returning from the applicator 2 through the feeding waveguide 5 to a water load 4, thereby protecting the generator from the reflected microwave power. Further, a sensor 40 for measuring the reflected microwave power is provided at an appropriate point along the return path to the water load 4.

The feeding waveguide 5 is dimensioned as a single-mode waveguide such that only the fundamental $TE_{10}$ (Transverse Electric) mode of microwave power propagates through the waveguide. The $TE_{10}$ mode is also called as a $H_{10}$ mode. The waveguide 5 is formed by a rectangular tube that has cross section a by b meters, with wall planes z-y and z-x. Axes x, y and z illustrate a rectangular coordinate system at the output of the feeding waveguide 5. When an electromagnetic wave propagates down the waveguide in direction z (the longitudinal axis of the waveguide), the electric field has only y component (along the y-axis, i.e. the shorter lateral side of the rectangular cross-section of the standard rectangular waveguide). An example of suitable waveguide for the microwave of 915 MHz, is a standard waveguide WR975 with inside dimensions are b=124 mm and a=248 mm.

The output of the feeding waveguide 5 is connected to an input of a waveguide transition 6. The input end of the waveguide transition 6 has a rectangular cross section of a by b meters equal to that of the feeding waveguide 5, e.g. a=248 mm and b=124 mm. However, the output of the waveguide transition 6 has an enlarged cross-section C*b by a meters in which the length of side along y is enlarged by a factor C, wherein C>2, while a is unchanged. The value of factor C may be selected depending on the width of the planar product to be heated. In the example discussed below, the C*b=600 mm and a=248 mm. Transition between these waveguides of different cross-sections is implemented by a suitable manner such that substantially only the fundamental $TE_{10}$ mode exists in both waveguides. This condition ensures uniform distribution of the electric field intensity along the enlarged side C*b, e.g. 600 mm.

The output end of the waveguide transition 6 can be coupled to an input end of a heating cavity or microwave applicator 2 (a cavity resonator) having the matching cross-sectional dimensions. The planar product 8 to be heated by the microwave energy travels across the cavity by means of a suit-able conveyor or drive arrangement (not shown). A pressing system (not shown), such a metal piston press, may be located immediately after the applicator 2. It should be appreciated that the microwave applicator described herein is only one example of microwave applicators, or more generally microwave components which an element according to the present invention can be connected to.

Figure 2:
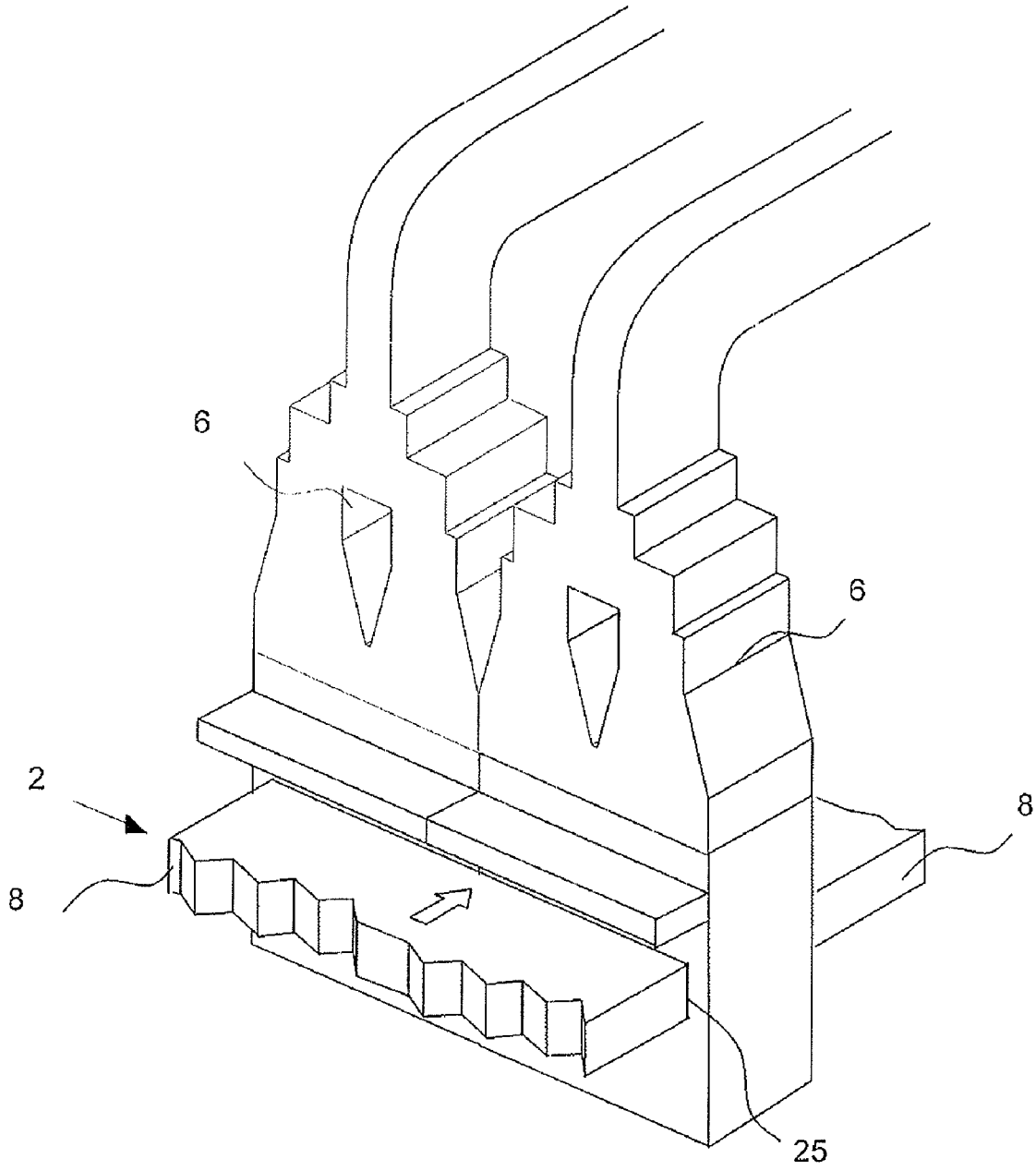
FIG. 2 illustrates an example structure of a heating apparatus according to an embodiment of the present invention, in which two waveguide elements are installed in parallel.

The apparatus shown in FIG. 1 allows implementing a microwave heating for planar products of large range of width, from 30 centimeters up to 1 to 3 meters. The primary limiting factor may be the maximum microwave power available from the generator 10. When the microwave energy is distributed wider in the direction of the Y-axis, the smaller is the microwave power per unit of length (e.g. 1 mm) in that direction. Thus, there is a width where the heating power is not sufficient for heating the planar product. According to an embodiment of the invention, an adequate heating of very wide products can be provided by means of installing two or more applicators 2 in parallel, as shown in FIG. 2. Each applicator 2 may be fed from a different generator (such as the generator 10 shown in FIG. 1) via a different waveguide transition 6 according to the present invention, as also shown in FIG. 2. At the slot openings 25, the abutting sidewalls of the applicators are removed, resulting in slot openings and product track twice (or more) as wide as in a single applicator 2. Thus, the width of the planar product 8 that can travel through the joined applicators is doubled (or more) in comparison with a single applicator.

Figure 3:
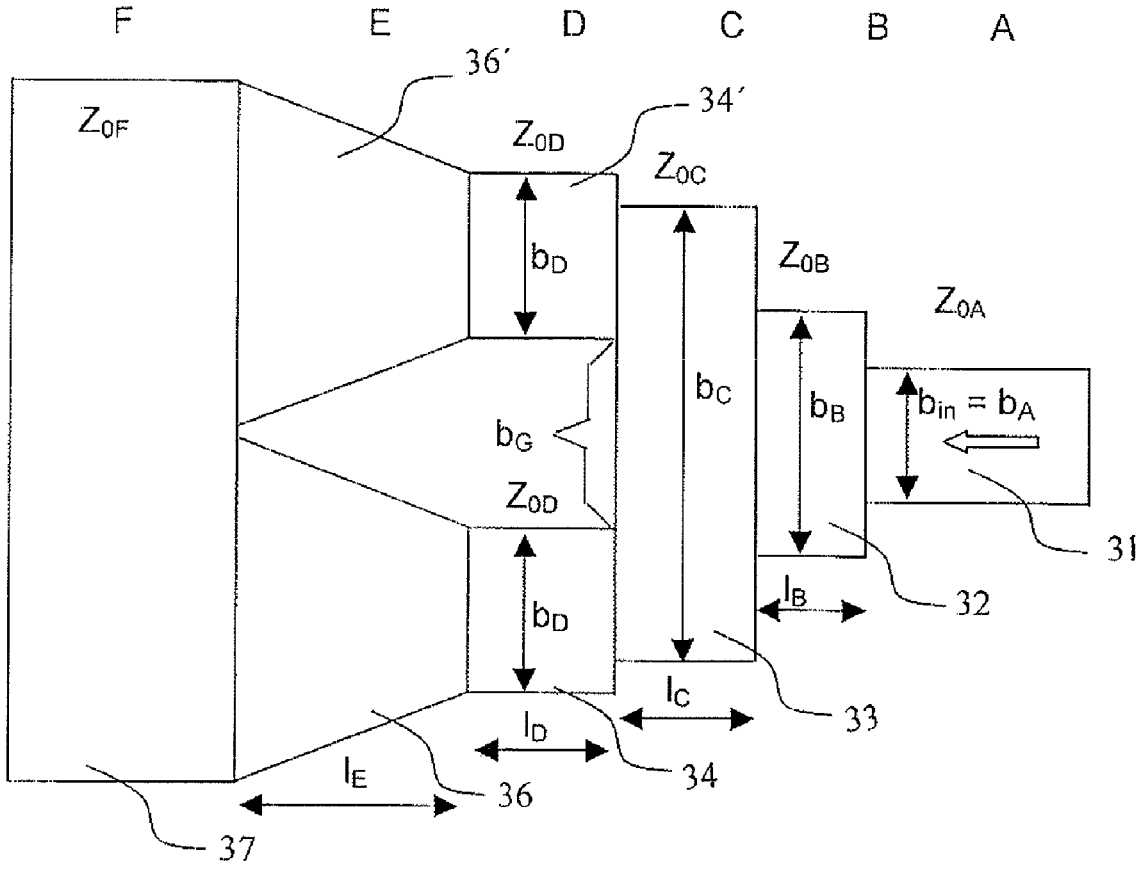
FIG. 3 shows a waveguide element according to an exemplary embodiment of the invention.

According to an aspect of the invention, an input port 31 and the output port 37 of the waveguide transition 6 are matched by a plurality of intermediate waveguide segments B, C, D, and E cascaded in the propagation direction of the microwave power for gradually enlargening the width of the waveguide transition 6, as illustrated in the exemplary embodiment shown in FIG. 3. In the example of FIG. 3, the input port and the output port 37 are formed by segments A and F, respectively. The segment A may also be part of a standard feeding waveguide (or some other microwave element preceding the waveguide transition 6) and/or the segment F may also be part of the heating cavity 2 (or some other microwave element following the waveguide transition 6).

The intermediate waveguide segments B, C, D, and E are preferably dimensioned such that respective characteristic impedances are approximately matched with each other for the fundamental mode. The lengths of the intermediate waveguide segments B, C, D, and E in the propagation direction are $I_B$, $I_C$, $I_D$, and $I_E$, respectively. In an embodiment of the invention, $I_B$, $I_C$, and $I_D$ each is approximately equal to a quarter of a wavelength λ of the fundamental mode in the waveguide. In an embodiment of the invention, the length of the waveguide segment F is approximately equal to a half of a wavelength λ.

According to an embodiment of the invention, the intermediate waveguide segments C and D are arranged to split the waveguide element into two symmetrical waveguide branches. The waveguide 32 of the first immediate segment B is attached to waveguide 31 and to the waveguide 33 of the waveguide segment C. The opposite end of the waveguide 33 has two symmetrical output ports each opening to one of the branches. In the first branch, the segment D is formed by a waveguide 34, and the segment E is formed by a waveguide 36. In the parallel second branch, the segment D is formed by a waveguide 34', and the segment E is formed by a waveguide 36' The horn-shaped waveguides 36 and 36' are arranged side-by-side and attached to the output port 37 (segment F). The width of the each waveguide 36 and 36' at the output end is preferably approximately one half of the width of the output port in direction of the electric field. According to an embodiment of the invention, the waveguides 36 and 36' each has conical enlargement of shape in the plane of the electric field of the fundamental mode. The interferences generated in the two symmetrical waveguide branches are of opposite phases such that they cancel each other at the output port 37. As a result, the uniformity of the electric field is improved.

Referring to FIG. 3, let us consider an example wherein the width of the input port 31 in the direction of the electrical field is $b_A$, the width of the waveguide 32 in the segment B is $b_B$, the width of the waveguide 33 in the segment C is $b_C$, and the width of the waveguides 34 and 34' in the segment D is $b_D$, wherein $b_C>b_B>b_A$, wherein $b_A=b_{in}$. The waveguides 34 and 34' are dimensioned such that $2*b_D+b_G>b_C$, wherein $b_G$ is the spacing between the waveguides 34 and 34'.

Segments A and C can be matched with the intermediate segment B whose length $I_B$ is λ/4 and characteristic impedance $Z_{0B}$ is $$Z_{0B}=\sqrt{Z_{0A}Z_{0C}}$$

wherein $Z_{0A}$ is the characteristic impedance of the segment A (the input port), and $Z_{0C}$ is the characteristic impedance of the segment C.

Similarly, the characteristic impedance $Z_{0C}$ can be determined as $$Z_{0C}=\sqrt{2Z_{0D}Z_{0B}}$$

wherein $2Z_{0D}$ is a series connection of the characteristic impedances of the waveguides 34 and 34'. $Z_{0F}$ is the characteric impedance of the segment F.

In the case of a rectangular waveguide, the characteristic impedance for the fundamental mode is proportional to the width of the waveguide. Thus, we obtain $$b_B=\sqrt{b_A b_C}$$

Taking into consideration waveguide bifurcation, we have $$b_D=0.5(b_C=b_G)^2/b_B$$

Approximate values for the dimensions $b_B$, $b_D$ may be determined with these relationships for given values of $b_A$, $b_C$ and $b_G$. Values of $b_A$ and the wavelength $\lambda$ are typically known. Values of $I_B$, $I_C$, $I_D$ may be $\lambda/4$ and $I_E$ may be $\lambda/2$. For example, for the frequency of 915 MHz, the $b_A$=124 mm, and $\lambda$=437 mm. When setting $b_C$=400 mm and $b_G$=140 mm, we obtain $b_B$=223 mm and $b_D$=151 mm. The other cross-sectional dimension is 248 mm in each segment. Final dimensions have to be found by electromagnetic simulations or experimentally.

Figure 4A:
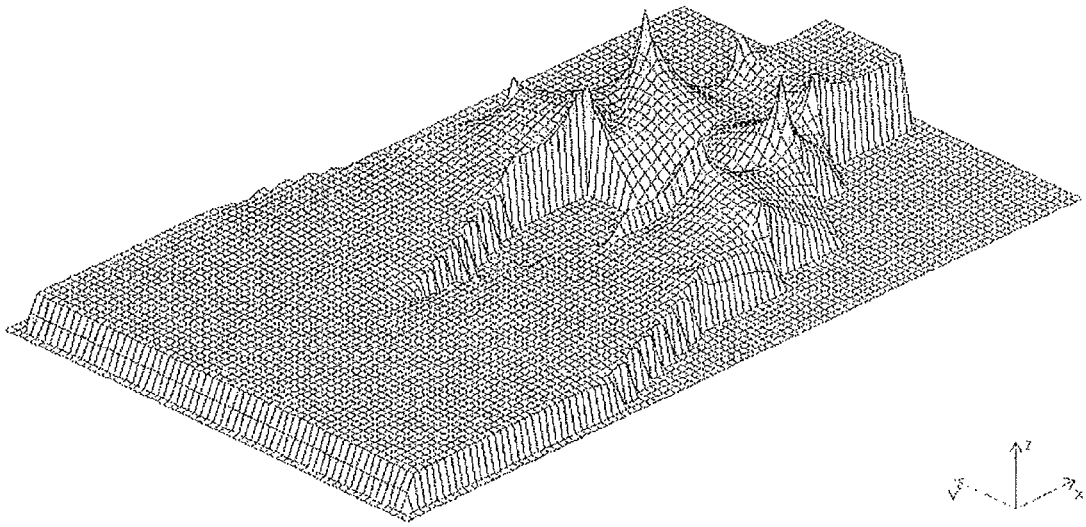
FIGS. 4*a* and 4*b* are graphs illustrating an average envelope distribution along the waveguide element of the electric field intensity and the magnetic field intensity, respectively, according to an embodiment of the invention.
Figure 4B:
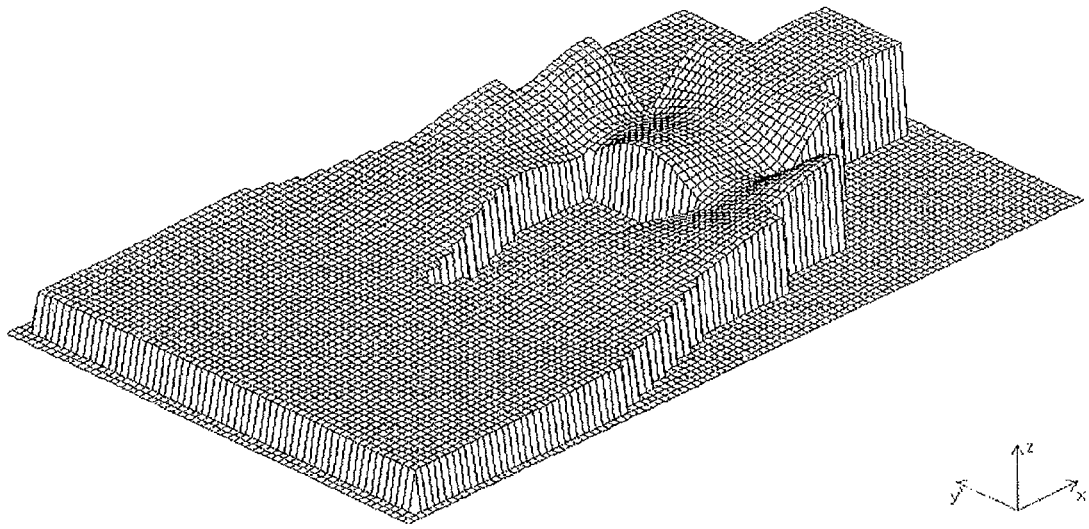

Improved transition have been tested by the electromagnetic simulator. FIGS. 4*a* and 4*b* show the average envelope distribution along the transition of the electric field intensity and the magnetic field intensity, respectively, according to an embodiment of the invention. The patterns of the fields are uniform along y axis at the output of the transition. The ratio of maximum value of the electric or magnetic field to minimum value along y axis is 1.016.

While particular example embodiments according to the invention have been illustrated and described above, it will be clear that the invention can take a variety of forms and embodiments within the spirit and scope of the appended claims.

The invention claimed is:

1. A waveguide element, wherein the waveguide element is in form of a rectangular pipe made of electrically conducting material, the waveguide element comprising an input port having a standard rectangular cross-section with the width of the input port being $b_A$ in a direction of an electric field of the fundamental mode propagating in the waveguide element, the direction of the electric field being perpendicular to a propagation direction of a microwave power, an output port having an enlarged rectangular cross-section, the width of the output port being $C*b_A$ in the direction of the electric field of the fundamental mode, wherein C is an enlargement factor greater than one, a plurality of intermediate waveguide segments cascaded in the propagation direction of the microwave power and arranged to split the waveguide element into two symmetrical waveguide branches which are combined at the output port, the waveguide branches terminating to symmetrical horn-shaped waveguide segments of width $C*b_A/2$ which are arranged to open to the output port, and wherein each one of the intermediate waveguide segments comprise a first intermediate waveguide segment having width $b_B$ in the direction of the electric field of the fundamental mode, wherein $b_B>b_A$, a second intermediate waveguide segment having width $b_C$ in the direction of the electric field of the fundamental mode, wherein $b_C>b_B$, third and fourth intermediate waveguide segments located in parallel to each other with a spacing $b_G$ to form first segments of said symmetrical waveguide branches, the third and fourth intermediate waveguide segments each having width $b_D$ in the direction of the electric field of the fundamental mode, wherein $(2*b_D+b_G)>b_C$.

2. A waveguide element according to claim 1, wherein each one of the symmetrical horn-shaped waveguide segments has enlargening shape in a plane of the electric field of the fundamental mode.

3. A waveguide element according to claim 2, wherein respective ones of the horn-shaped symmetrical waveguide segments are attached to the third and fourth intermediate waveguide segments at first ends thereof, and to the output port at opposite ends thereof.

4. A waveguide element according to claim 1, wherein a length of each of the second plurality of intermediate waveguide segments in the propagation direction of the microwave power is approximately equal to a quarter wavelength of the fundamental mode in the waveguide.

5. A waveguide element according to claim 1, wherein a length of each of the symmetrical horn-shaped waveguide segments in the propagation direction of the microwave power is approximately equal to a half wavelength of the fundamental mode in the waveguide.

6. A waveguide element according to claim 1, wherein the widths $b_A$, $b_B$, $b_C$ and $b_D$ are dimensioned such that respective characteristic impedances are approximately matched with each other for the fundamental mode.

7. A waveguide element according to claim 1, wherein $C*b_A$ is within a range from 30 centimeters up to at least 70 centimeters.

8. An apparatus for microwave heating of a planar product, said apparatus comprising i) a first waveguide element in form of a rectangular pipe made of electrically conducting material, the first waveguide element further comprising an input port having a standard rectangular cross-section with the width of the input port being $b_A$ in a direction of an electric field of the fundamental mode propagating in the waveguide element, the direction of the electric field being perpendicular to a propagation direction of a microwave power, an output port having an enlarged rectangular cross-section, the width of the output port being $C*b_A$ in the direction of the electric field of the fundamental mode, wherein C is an enlargement factor greater than one, a plurality of intermediate waveguide segments cascaded in the propagation direction of the microwave power and arranged to split the waveguide element into two symmetrical waveguide branches which are combined at the output port, the waveguide branches terminating to symmetrical horn-shaped waveguide segments of width $C*b_A/2$ which are arranged to open to the output port, and wherein each one of the intermediate waveguide segments comprise a first intermediate waveguide segment having width $b_B$ in the direction of the electric field of the fundamental mode, wherein $b_B>b_A$, a second intermediate waveguide segment having width $b_C$ in the direction of the electric field of the fundamental mode, wherein $b_C>b_B$, third and fourth intermediate waveguide segments located in parallel to each other with a spacing $b_G$ to form first segments of said symmetrical waveguide branches, the third and fourth intermediate waveguide segments each having width $b_D$ in the direction of the electric field of the fundamental mode, wherein $(2*b_D+b_G)>b_C$, ii) a feeding waveguide having said standard rectangular cross-section and being connected to said input port of the first waveguide element, and iii) a heating cavity having said second rectangular cross-section and being connected to said output port of the first waveguide element.

9. An apparatus as claimed in claim 8, comprising a further waveguide element having the same structure as said first waveguide element, a further feeding waveguide having said standard rectangular cross-section and being connected to an input port of the further waveguide element, and a further heating cavity having said second rectangular cross-section and being connected to an output port of the further waveguide element, wherein the heating cavities are provided side-by-side and attached to each other for heating planar products twice as wide as a single cavity.

* * * * *